US006997125B1

(12) United States Patent
Kobayashi et al.

(10) Patent No.: US 6,997,125 B1
(45) Date of Patent: Feb. 14, 2006

(54) AUTOMATED SEWING DEVICE

(75) Inventors: Yukihito Kobayashi, Akishima (JP); Yoshiyuki Takei, Akishima (JP)

(73) Assignee: Tachi-S Co., Ltd., Tokyo (JP)

( * ) Notice: Subject to any disclaimer, the term of this patent is extended or adjusted under 35 U.S.C. 154(b) by 0 days.

(21) Appl. No.: 11/001,005

(22) Filed: Dec. 2, 2004

(51) Int. Cl.
*D05B 21/00* (2006.01)

(52) U.S. Cl. ..... 112/470.09; 112/153

(58) Field of Classification Search ..... 112/470.09, 112/470.14, 470.18, 470.27, 308, 309, 148, 112/153
See application file for complete search history.

(56) References Cited

U.S. PATENT DOCUMENTS

| | | | | |
|---|---|---|---|---|
| 4,899,674 A | * | 2/1990 | Kawasaki | 112/470.09 |
| 4,899,675 A | * | 2/1990 | Kawasaki | 112/470.09 |
| 6,935,259 B1 | * | 8/2005 | Kobayashi et al. | 112/470.09 |

FOREIGN PATENT DOCUMENTS

| | | |
|---|---|---|
| JP | 54-72966 U | 5/1979 |
| JP | 7-194870 A | 8/1995 |
| JP | 2691737 B2 | 9/1997 |

* cited by examiner

*Primary Examiner*—Peter Nerbun
(74) *Attorney, Agent, or Firm*—Browdy and Neimark, PLLC

(57) ABSTRACT

The automated sewing device itself includes several known constitutional elements similar to those of the earlier described prior-art automated sewing devices. Namely, a known sewing machine (M) having a sewing needle (32), a pressure foot member (31), and a feed dog member (33) is fixedly provided on a table (3), and a stationary guide plate (2) having a pair of first and second guide grooves (20A) (20B) formed therein is fixedly mounted on the table (3). And, movably attached on that stationary guide plate (2) is a movable guide plate (1) which has a pair of guide rollers (12)(12) rotatably provided on the reverse side thereof. Designation (30) denotes a guide member disposed adjacent to the sewing needle (32), which is so designed that both end portions (53) and (63) respectively of the first and second base materials (5)(6) will be slidably contacted therewith and thereby be guided in a direction to that sewing needle (32).

5 Claims, 4 Drawing Sheets

AUTOMATED SEWING DEVICE

BACKGROUND OF THE INVENTION

1. Field of the Invention

The present invention relates to an automated sewing device for automatically sewing together two juxtaposed end portions respective of two different base materials of different shapes each of which has been cut formed in a predetermined shape.

2. Description of Prior Art

The automated sewing device of the afore-stated kind is known in the art, and in particular, various kinds of automated sewing devices have been disclosed, which are capable of automatically sewing a curved end of one material with a rectilinear or uneven end of another material, or vice versus. Typical examples of such sewing devices are known from the Japanese Laid-Open Utility Model Publication No. 54-72966, the Japanese Patent No. 2691737, and the Japanese Laid-Open Patent Publication No. 7-194870.

According to those known automated sewing devices, one curved end portion of first material is automatically guided in a fixed direction to a sewing needle through automatically controlled movement of a guide plate on which the first material is secured, while another straight or uneven end portion of second material is also automatically guided in a proper direction so as to be in alignment with that one curved end portion of first material. In this way, a fixed margin to seam is attained constant in both of those first and second materials, so that both end portions of the first and second materials are neatly aligned with each other and sewn together, with a seam extending precisely along the thus-sewn two end portions.

In the case of forming a seat cover for use on automotive or vehicle seat, the so-called "trim cover assembly" having a certain multi-layered structure is formed in most instances. Typically, a material for forming such trim cover assembly for automotive seat is of a three-layer lamination structure comprising a top cover layer, a foam wadding layer, and a wadding cover layer in this order (see FIGS. 8 (A) and 8 (B)). Hence, this sort of material is relatively large in thickness. In practical assembly of seat cover materials, a plurality of such three-layered thick materials are stacked on top of each other in layers and then trimmed all at once into a given shape, with the result that some of so trimmed materials become irregular in their respective contours and causes some portions that are not made to measure.

In this connection, the above-noted conventional automated sewing devices operate to sew together the materials with a fixed seam allowance. If the foregoing irregular sizes of materials are sew together by that automated sewing device, a resulting sewn product inevitably has some portions irregular in size. That is, if the materials that have been cut or trimmed into a size larger than a predetermined size as stated above are sewn together with a fixed seam allowance by the known automated sewing device, a resulting sewn product inevitably has some large portions exceeding the predetermined size. Or, if the materials that have been cut or trimmed into a size smaller than a predetermined size are likewise automatically sewn together with a fixed seam allowance, a resulting sewn product inevitably has some portions smaller than the predetermined size.

SUMMARY OF THE INVENTION

In view of the above-stated drawbacks, it is a purpose of the present invention to provide an improved automated sewing device which effectively allows for precisely sewing together first and second base materials along a certain sewing line into a sewn product without any irregular or unsized portions which are not in conformity with a required actual size.

In order to achieve such purpose, an automated sewing device in accordance with the present invention is basically comprised of:

a sewing machine including a sewing needle;

a stationary guide element;

a movable guide element having one end, the movable guide element being movably provided on the stationary guide element and being adapted to allow the first base element to be placed thereupon, with the one curved end portion thereof projecting outwardly from the foregoing one end of the movable guide element;

the stationary guide element including a guide means for defining a locus along which the movable guide element is to be moved on the stationary base guide element in order to guide the curved end portion of the first base material placed on the movable guide element in a direction to the sewing needle of the sewing machine;

and a reference guide means provided on the movable guide element, the reference guide means defining a reference location at which another end portion of the first base material opposite to the curved end portion thereof is to be set.

Accordingly, by virtue of the reference guide means, the first base material is precisely retained at a position for allowing its curved end portion to be sewn with the end portion of the second base material automatically, irrespective of whether the width-wise size of the first base material may be wider or smaller than a required constant width-wise size. Hence, even a base material having end portions not made to measure can be subjected to automated sewing with another base material, so that a resulting sewn product can be formed in a required actual size, as originally designed.

Preferably, the reference guide means may be formed in a shape conforming to the a shape of the foregoing another end portion of the first base material, with a view to facilitating the ease with which the first base material is set by the reference guide means.

Other features and advantages will become apparent from reading of the descriptions, thereinafter, with reference to the annexed drawings.

BRIEF DESCRIPTION OF THE DRAWINGS

FIG. 3 (B) is a schematic plan view showing the state where such first base material shown in the FIG. 3 (A) is placed on the movable guide plate and set thereon by the reference guide element;

FIG. 4 (B) is a schematic plan view showing the state where such first base material shown in the FIG. 4 (A) is placed on the movable guide plate and set thereon by the reference guide element;

FIG. 8 (B) is a partly broken sectional of a second base material.

DETAILED DESCRIPTION OF PREFERRED EMBODIMENTS OF THE INVENTION

Referring to FIGS. 1 to 8, there is illustrated one preferred mode of automated sewing device in accordance with the present invention, which is operable to sew one curved end portion (63) of a second base material (6) with one sinuously curved end portion (53) of a first base material (5) into a predetermined shape of trim cover assembly (not shown) for covering a part of automotive seat (not shown).

Figure 2:
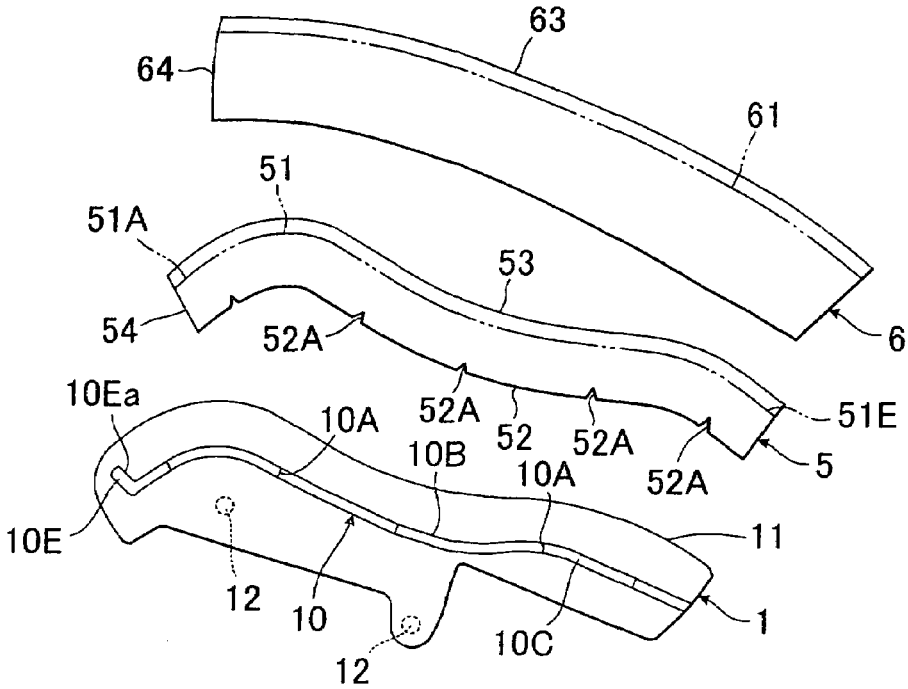
FIG. 2 is a schematic plan view showing a movable guide plate, a reference guide element provided on the movable guide plate, a first base material and a second base material, all of which are used in the automated sewing device.
Figure 8:
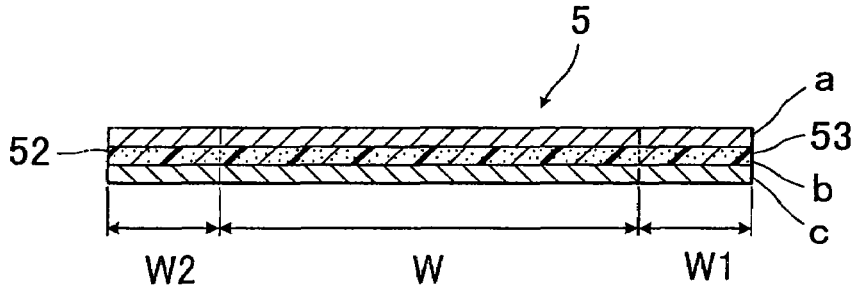
FIG. 8 (A) is a sectional view of the first base material.
Figure 8:
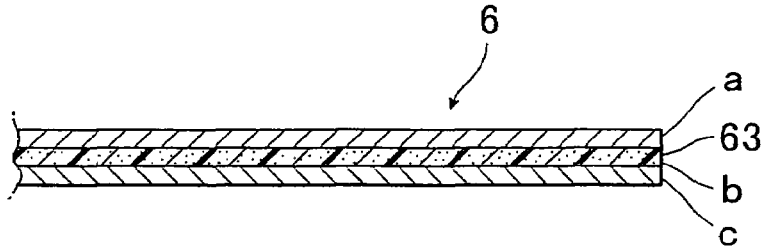

As best shown in FIGS. 8 (A) and 8 (B), each of the first and second base materials (5) (6) which are to be sewn together is of a three-layer lamination structure comprising a top cover layer (a), a slab foam wadding layer (b) and a wadding cover layer (c), as typically known in the art. For example, as shown in FIG. 2, the first base material (5) is formed in a sinuous shape, having the sinuously curved end portion (53), whereas the second base material (6) is formed in a gently curved shape, having the curved end portion (63).

The automated sewing device itself includes several known constitutional elements similar to those of the earlier described prior-art automated sewing devices. Namely, a known sewing machine (M) having a sewing needle (32), a pressure foot member (31), and a feed dog member (33) is fixedly provided on a table (3), and a stationary guide plate (2) having a pair of first and second guide grooves (20A) (20B) formed therein is fixedly mounted on the table (3). And, movably attached on that stationary guide plate (2) is a movable guide plate (1) which has a pair of guide rollers (12)(12) rotatably provided on the reverse side thereof. Designation (30) denotes a guide member disposed adjacent to the sewing needle (32), which is so designed that both end portions (53) and (63) respectively of the first and second base materials (5)(6) will be slidably contacted therewith and thereby be guided in a direction to that sewing needle (32).

Figure 1:
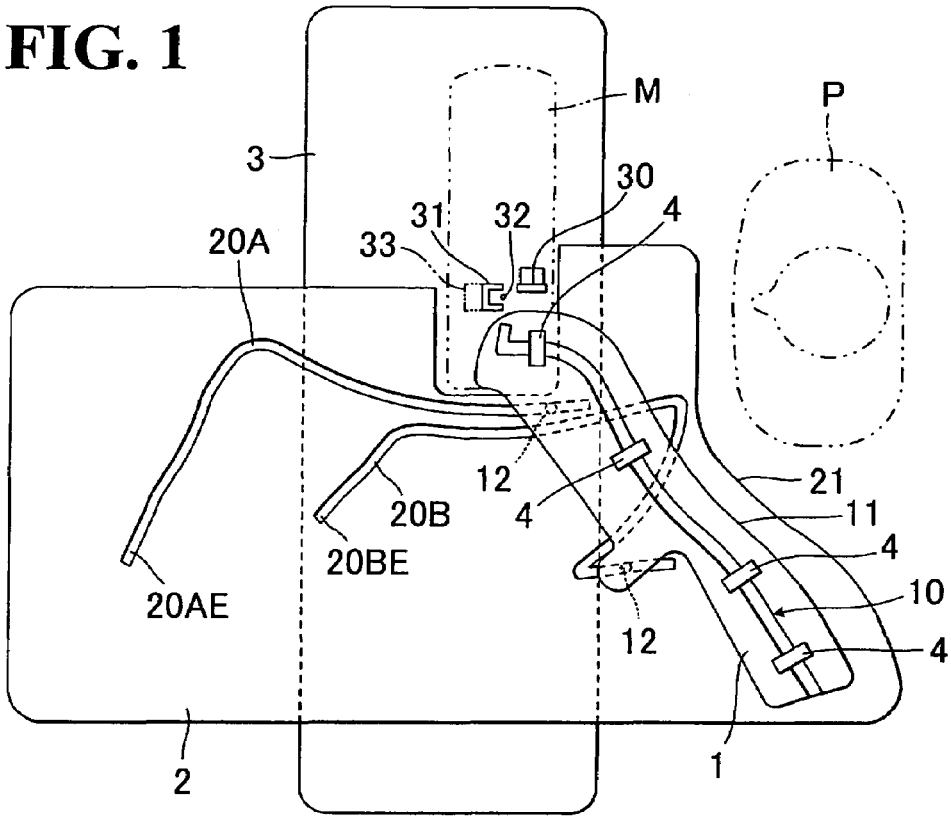
FIG. 1 is a schematic plan view showing an exemplary mode of an automated sewing device in accordance with the present invention.

Designation (P) denotes a worker who operates the present automated sewing device. As shown in FIG. 1, the stationary guide plate (2) is formed with a recessed region (21) which allows the worker (P) to easily manipulate and guide the two base materials (5) (6), while operating the present sewing device.

As shown, the movable guide plate (1) is movably placed on the stationary guide plate (2) in such a manner that the first and second guide rollers (12) are rotatably engaged in the respective two guide grooves (20A) (20B) formed in the upper surface of the stationary guide plate (2). In brief, the formation of those first and second guide grooves (20A) (20B) is based on two different loci along which the first and guide rollers (12A) (12B) are respectively to be moved in order for the movable guide plate (1) to move in a required direction to cause the curved end portion (53) of the first base material (5) to move in a tangential direction to the sewing needle (32), so that both two end portions (53) (63) respective of the first and second base materials (5) (6) are sewn together along a predetermined sewing line (see the designation (SL) or (51 and 61) in FIG. 5), with a predetermined seam allowance (W1). This kind of automated guide arrangement is know from the previously described Japanese prior-art publications, and thus, any further detailed explanation thereof is omitted.

In this context, as previously described, the first and second base materials (5) (6) are relatively large in thickness due to their respective three-layer lamination structures, and in practical assembly of seat cover materials, a plurality of such thick materials are stacked on top of each other in layers and then trimmed all at once into a given shape. As a consequence thereof, some of the thus-trimmed materials are found to be irregular or unsized in their respective contours and causes some portions that are in no way made to measure as originally designed. For example, as shown in 3 (A), there may be the case where the first base material (5) has a outwardly projected irregular area (52L) which is larger in size or width than a required actual size or width (W), as indicated by (WL), in relation to the sewing line (at 51 or 61) along which the curved end portion (53) of the first base material (5) is to be sewn by the sewing machine (M) with one curved end portion (63) of the second base material (6). Also, as shown in FIG. 4(A), there may be the case where the first base material (5) has an inwardly recessed irregular area (52S) which is smaller in size or width than the required actual size or width (W), as indicated by (WS), in relation to the sewing line.

Since the automated sewing device per se operates to sew together the two materials (5) (6) in one fixed direction, the foregoing irregular size of the first base material end portion (53) is directly sewn with the second base material end portion (63) by that automated sewing device, with the result that a resulting sewn product inevitably has an unsized portion at the outwardly projected irregular area (52L) or the inwardly recessed irregular area (52S), as described previously.

However, in accordance with the present invention, the movable guide plate (1) has a meandering or curved edge (11) which is formed along the sinuously curved extremity of the above-stated sinuously curved end portion (53) of the first base material (5), and in particular, provided on that movable guide plate (1) is a reference guide means for defining a reference location or line along which another end portion (52) of the first base material (5) is to be set precisely at a predetermined position with respect to a sewing line (51), irrespective of the above-discussed irregular local areas found in the first base material (5), and irrespective of whether the width-wise size of the first base material (5) (i.e. a width between one and another end portions (52) (53) of that first base material (5)) may be larger or smaller than a required width-wise size (W), thereby allowing the curved end portion (53) of the first base material (5) to be sewn automatically with the curved end portion (63) of the second base material (6), while insuring to keep the required actual size or width (W) in the first base material (5) with respect to and along the sewing line (SL) or seam.

Specifically, as shown in FIG. 2 for instance, such reference guide means may be embodied by an elongated reference plate (10) which is formed in a sinuous shape substantially equal to the sinuous edge (11) of the movable guide plate (1) which is in turn identical in shape to the sinuous end portion of the first base material (5). Such elongated reference plate (10) is fixedly mounted on the upper surface of the movable guide plate (1) so as to extend longitudinally thereof in a direction from a forward end to backward end of the movable guide plate (1) in a meandering manner, as shown in the FIG. 2. The reference plate (10) has a positioning end portion (10E) formed in a forward end thereof which is to be set at an start point for sewing as shown in FIG. 1, so that a forward end (54) of the first base material (5) is precisely positioned by that positioning end portion (1E) and other remaining portion of the first base material (5) is positioned in place along the reference plate (10). As can be seen from FIG. 5, the reference plate (10) has a height-wise thickness substantially equal to the thickness of the first base material (5), so that the upper surface (10C) thereof is substantially in registry with the outer surface of the latter (5). Also, the reference plate (10) has one vertical lateral wall (10B) with which another end portion (52) of the first base material (5) is to be contacted.

Figure 6:
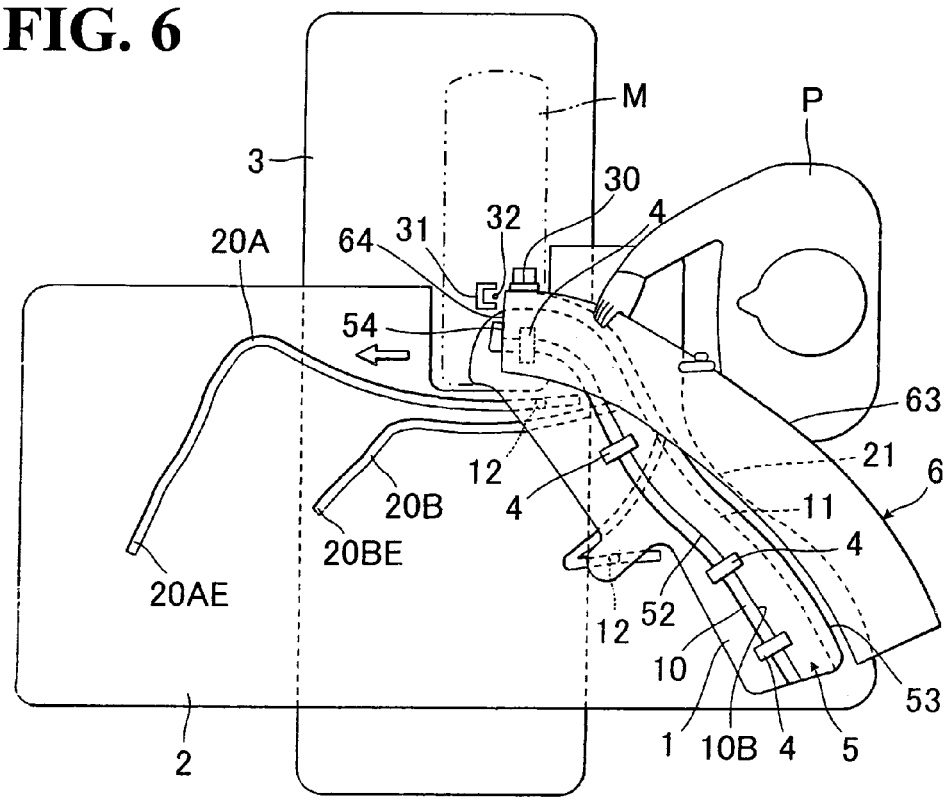
FIG. 6 is a plan view showing operation of the automated sewing device.
Figure 7:
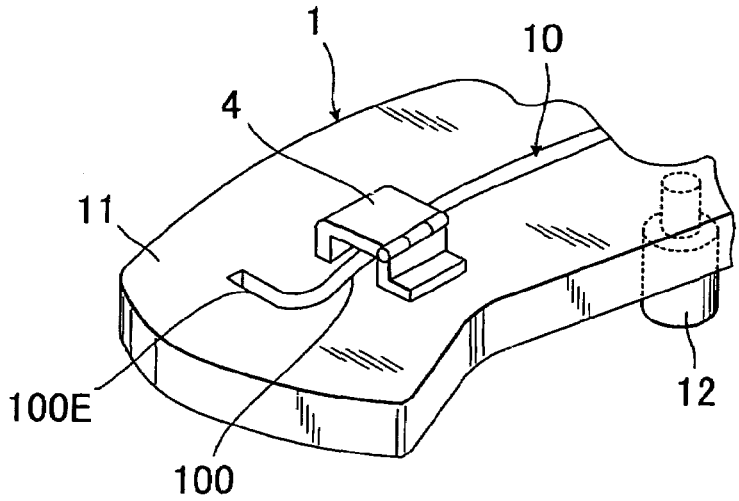
FIG. 7 is a partly broken perspective view showing another alternative mode of the reference guide element.

It is noted here that the wording, "forward", refers to a direction in which the movable guide plate (1) moves forwards or advances as indicated by the arrow in FIG. 6 in a practical sewing operation of the present sewing device, whereas the wording, "backward", refers to a direction opposite to such forward direction.

Designations (10A) denote a plurality of positioning marks affixed on the upper surface (10C) of the elongated reference plate (10). Those positioning marks are disposed in correspondence with the respective plurality of positioning notches (52A) formed in another end portion (52) of the first base material (5), for a positioning purpose to be set forth later.

Designations (4) denote a plurality of clamp members which are fixed on the movable guide plate (1) so as to be disposed along and adjacent to the reference plate (10). As understandable from FIGS. 1, 5 and 7, each of the clamp members (4) is rotatable vertically to and from the upper surface of the movable guide plate (1), so that one end portion of each clamp member (4) can be set at a given securing point, bridging over the reference plate (10), so as to positively retain the foregoing another end portion (52) of the first base material (5) along the reference guide plate (10) at that securing point upon the movable guide plate (1).

A description will now be made of operation of the automated sewing device.

Figure 3:
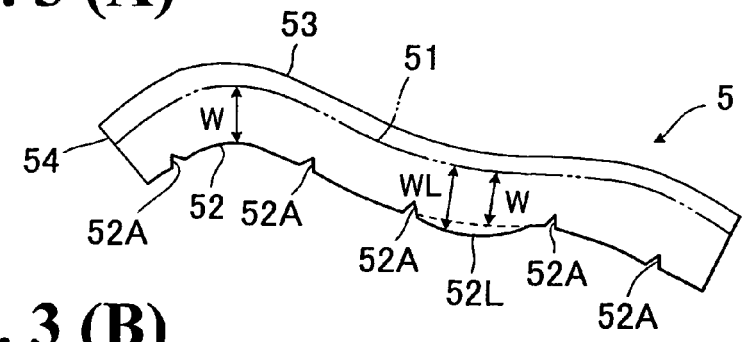
FIG. 3 (A) is a schematic plan view showing the case where the first base material has an outwardly projected irregular end area.
Figure 3:
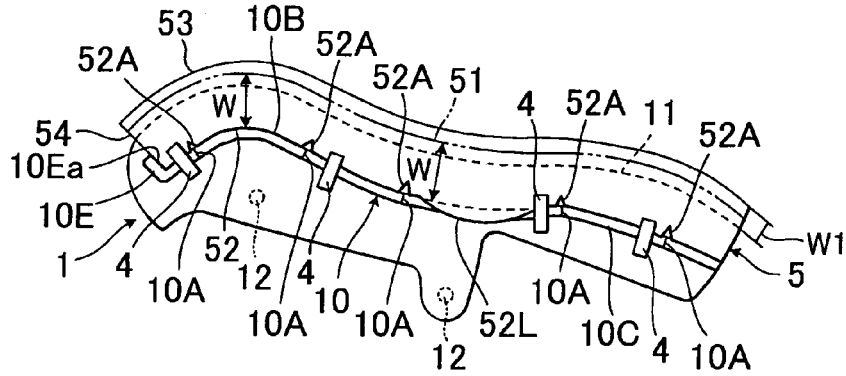

At first, FIG. 3 (A) shows the case where the first base material (5) has an outwardly projected irregular end area (52L) in the end portion (52) thereof, which is projected outwardly to increase a distance from the sewing line (51), thus providing a large width (WL) relative to a required actual size or width (W). In that case, as shown in FIG. 3 (B), the first base material (5) is placed on the movable guide plate (1), such that another end portion (52) thereof is contacted with and along the vertical wall (10B) of the reference guide plate (10), while all the positioning notches (52A) thereof are aligned with all the respective positioning marks (10A) of the latter. On the other hand, the curved end portion (53) of the first base material (5) projects a given distance from the outer edge (11) of the movable guide plate (1), thus defining a portion to be sewn with and along one end portion (63) of the second base material (6). Namely, a seam allowance (W1) is provided in that portion. Of course, the forward end (54) of the first base material (1) is contacted with one vertical wall (10Ea) of the positioning end portion (10E). At this point, a worker (at P) should upturn the outwardly projected irregular end area (52L) and place it upon the upper surface (10C) of the reference guide plate (10), whereupon the seam allowance (W1) is set within a tolerable range with respect to the outer edge (11) of movable guide plate (1), thereby insuring to not only attain a precise sewing path or sewing line (at 51) that is not dislocated from a predetermined and required sewing line, but also keep a required actual size or width (W) from and along the sewing line (51). Alternatively, the worker may forcibly depress the outwardly projected end area (52L) against the vertical wall (10B) of reference guide element (10) for that purpose. At this point, as understandable from FIG. 6, the forward end region of one end portion (53) of the first base material (5) is in contact with the guide member (30). It is noted here that such particular irregular end area (52L) should be left as it is, without being retained to both of the reference guide plate (10) and movable guide plate (1).

Figure 5:
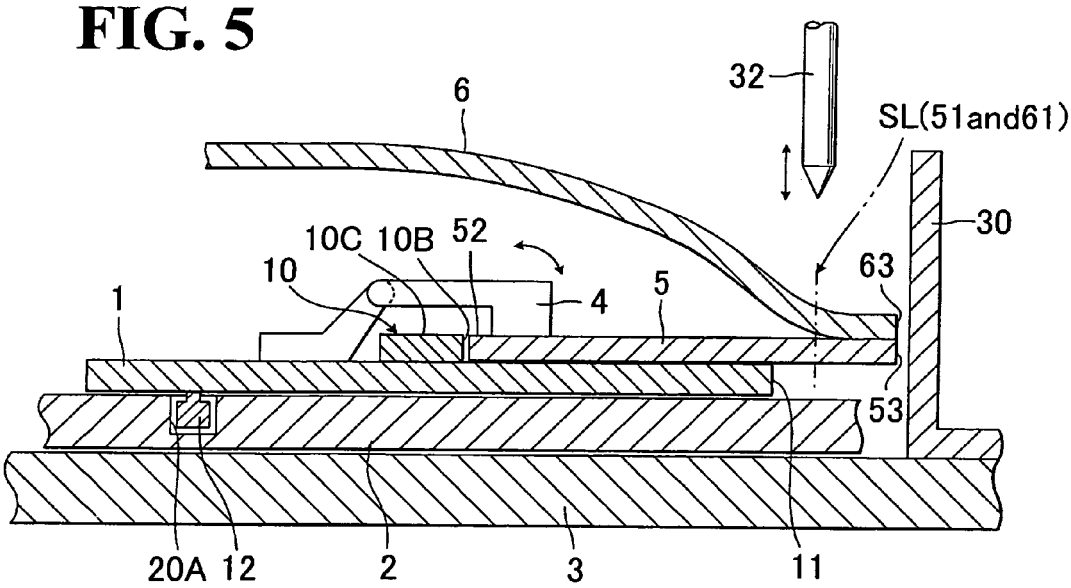
FIG. 5 is a fragmentary sectional view showing a principal part of the present invention.

Thereafter, all the clamps (4) are rotated down to contact upon another end portion (52) of the first base material (5), thereby retaining a whole of the first base material (5) against movement or dislocation from the reference guide plate element (10), excepting the outwardly projected irregular end area (52L). Then, as shown in FIGS. 5 and 6, a worker (P) brings the second base material (6) onto the thus-retained first base material (5), and aligns the forward end (64) of second base material (6) with the forward end (54) of that first base material (5), while insuring that the curved end portion (63) thereof is contacted at the forward end region thereof with the guide member (30), with his or he hands.

Upon switching on the sewing device or the sewing machine (M), both first and second base materials (5) (6) are automatically fed by operation of both feed dog member (33) and feed foot member (31) towards the sewing needle (32) and sewn together at and along their respective curved end portions (53) (63), while the second base material (6) is being manually held by the hands of worker (P) who simply guides the same (6) so as to insure that the end portion (63) thereof is kept contacted with the guide member (30), while allowing a whole of that particular end portion (63) to be smoothly and automatically sewn with and along a whole of end portion (53) of the first base material (5). Namely, as understandable from FIGS. 3 (A) to 6 in view of FIG. 2, from a start point (at 51A) to a terminal point (at 51E), the curved end portion (63) of the second base material (6) is automatically sewn with the curved end portion (53) of first base material (5). In brief, such automated sewing operation is based on a predetermined controlled movement of the movable guide plate (1) which is realized by the two guide rollers (12) being moved along the respective two guide grooves (20A) (20B) which form two required loci along which the two guide rollers (12) are respectively to travel so as to cause controlled movement of the movable guide plate (1) as described previously.

When both two base materials (5) (6) being sewing together reaches the terminal point (at 51E) and the two guide rollers (12) respectively reach the terminal point (20AE) of the first guide groove (20A) and the terminal point (20BE) of the second guide groove (20B), the present sewing device including the sewing machine (M) are automatically switched off and stopped.

Figure 4:
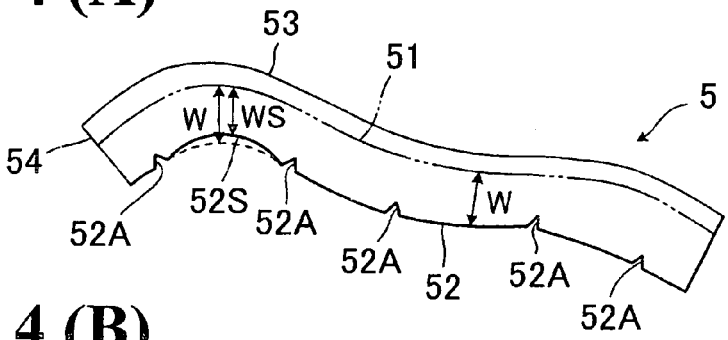
FIG. 4 (A) is a schematic plan view showing the case where the first base material has an inwardly recessed irregular end area.
Figure 4:
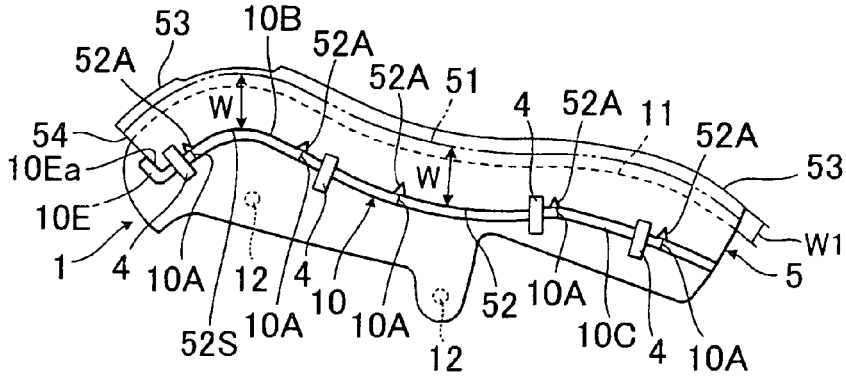

On the other hand, FIG. 4 (A) shows the case where the first base material (5) has an inwardly recessed irregular end area (52S) in the end portion (52) thereof, which is recessed to decrease a distance from the sewing line (at 51), thus giving a small width (WS) relative to a required actual size or a predetermined width (W). In that case, as understandable from FIG. 4 (B), when placing the first base material (5) on the movable guide plate (1) in the same manner as described above, the worker (P) should forcibly pull and bring the recessed irregular end area (52S) outwardly to contact with the vertical wall (10B) of the reference guide plate (10), whereupon the seam allowance (W1) is set within a tolerable range with respect to the outer edge (11) of the movable guide plate (1), thereby insuring to not only secure a precise sewing path or sewing line (51) that is not dislocated from a predetermined and required sewing line, but also maintain a required actual size (W) from the sewing line (51). It is noted here that the irregular end area (52S) should be left as it is, without being retained to both of the reference guide plate element (10) and movable guide plate (1). Thereafter, all the clamps (4) are rotated down to contact with another end portion (52) of the first base material (5), excepting the irregular end area (52S), thereby retaining a whole of the first base material (5) against movement or dislocation from the reference guide plate element (10). Then, all the subsequent sewing operations are effected in the same way as described earlier.

Accordingly, it is to be appreciated that, in accordance with the present invention, by virtue of the reference guide means or the reference guide plate (10), the first base material (5) is precisely retained at a position for allowing its curved end portion (53) to be sewn with the curved end portion (63) of the second base material (6) automatically, irrespective of whether the width-wise size of the first base material (5) (i.e. a width between its one and another end portions (52) (53)) may be wider or smaller than a required constant width-wise size. Hence, even a base material having slightly unsized or irregular end portions not made to measure can be subjected to automated sewing with another base material, so that a resulting sewn product can be formed in a required actual size, as originally designed.

While having described the present invention so far, it should be understood that the invention is not limited to the illustrated embodiment, but any other modification, replacement, and addition can be applied thereto without departing from the scopes of appended claims. For example, the aforementioned reference guide means may be embodied in a desired manner, and, as suggested in FIG. 7, instead of the reference guide plate (10), it may be embodied by a reference guide groove (100) which is formed in the upper surface of the movable guide plate (1) in a manner identical to the sinuous or curvilinear line of the reference guide plate (10) Or, it may be embodied by drawing a reference guide line likewise on the upper surface of the movable guide plate (1). The base materials (5) (6) used are not limited to a trim cover over assembly of automotive seat, but may be used to form another kind of trim cover assembly for use with a headrest, an armrest, or an interior of automobile.

What is claimed is:

1. An automated sewing device for automatically sewing a curved end portion of a first base material with an end portion of a second material, wherein said first base material is preformed as by trimming into a predetermined shape, comprising:

a sewing machine including a sewing needle;

a stationary guide element;

a guide means with which said end portion of said second material is to be contacted;

a movable guide element having one end, said movable guide element being movably provided on said stationary guide element and adapted to allow said first base material to be placed thereon, such that said one curved end portion of the first base material projects outwardly from said one end of said movable guide element;

said stationary guide element including a guide means for defining a locus along which said movable guide element is to be moved on the stationary guide element in order to guide said curved end portion of said first base material placed on said movable guide element in a direction to said sewing needle of said sewing machine; and a reference guide means provided on said movable guide element, said reference guide means having a reference location means with which another end portion of said first base material opposite to said curved end portion thereof is to be contacted.

2. The automated sewing device as claimed in claim 1, wherein said another end portion of said first base material is formed in a predetermined shape, and wherein said reference guide means is formed in a shape conforming to said predetermined shape of said another end portion of said first base material.

3. The automated sewing device as claimed in claim 1, wherein said another end portion of said first base material is formed in a shape substantially equal to said curved end portion thereof, and wherein said reference guide means is formed in a shape conforming to said shape of said another end portion of the first base material.

4. The automated sewing device as claimed in claim 1, wherein said reference guide means comprises a wall formed on said reference guide means.

5. The automated sewing device as claimed in claim 1, which further comprises a clamp means for retaining said another end portion of said first base material to said movable guide element, said clamp means being arranged adjacent to and along said reference guide means.

* * * * *